US007992879B2

(12) United States Patent
Eisenberg et al.

(10) Patent No.: US 7,992,879 B2
(45) Date of Patent: Aug. 9, 2011

(54) GROCERY CART BAGGING SYSTEM

(76) Inventors: Mikel Eisenberg, New York, NY (US); Kristen Brown, Murrells Inlet, SC (US)

( * ) Notice: Subject to any disclaimer, the term of this patent is extended or adjusted under 35 U.S.C. 154(b) by 0 days.

(21) Appl. No.: 12/372,967

(22) Filed: Feb. 18, 2009

(65) Prior Publication Data

US 2009/0232420 A1 Sep. 17, 2009

Related U.S. Application Data

(60) Provisional application No. 61/036,335, filed on Mar. 13, 2008.

(51) Int. Cl.

| | |
|---|---|
| ***B62D 39/00*** | (2006.01) |
| ***B65D 1/34*** | (2006.01) |
| ***B65D 30/16*** | (2006.01) |
| ***B65D 30/20*** | (2006.01) |
| ***B65D 33/06*** | (2006.01) |

(52) U.S. Cl. ..... 280/33.992; 206/554; 383/15; 383/37; 383/38; 383/104; 383/108; 383/110; 383/113; 383/120

(58) Field of Classification Search ..... 206/554; 150/107; 383/15–16, 18, 37–39, 104, 107, 383/113, 120, 905, 110, 108; 280/33.992, 280/33.991

See application file for complete search history.

(56) References Cited

U.S. PATENT DOCUMENTS

| | | | | | |
|---|---|---|---|---|---|
| 1,400,499 | A | * | 12/1921 | Henderson | 383/18 |
| 2,608,227 | A | * | 8/1952 | Witt | 383/16 |
| 2,871,900 | A | * | 2/1959 | Grace | 383/6 |
| 3,142,324 | A | * | 7/1964 | Leo | 383/120 |
| 3,549,084 | A | * | 12/1970 | Canno | 383/15 |
| 4,078,595 | A | * | 3/1978 | Mittelmann | 383/38 |
| 4,102,487 | A | * | 7/1978 | Soto | 383/27 |
| 4,240,480 | A | * | 12/1980 | Strobel | 383/15 |
| 4,542,826 | A | * | 9/1985 | Adams | 383/107 |
| 4,610,358 | A | * | 9/1986 | Walter | 383/110 |
| 4,717,262 | A | * | 1/1988 | Roen et al. | 383/120 |
| 4,867,215 | A | * | 9/1989 | Macieowitz | 150/113 |
| 4,871,100 | A | * | 10/1989 | Posner | 383/23 |
| 4,930,903 | A | * | 6/1990 | Mahoney | 383/104 |
| 4,978,231 | A | * | 12/1990 | Ling et al. | 383/37 |
| 5,038,842 | A | | 8/1991 | Huang et al. | |
| 5,046,860 | A | * | 9/1991 | Brennan | 383/38 |
| 5,127,536 | A | * | 7/1992 | Cohen et al. | 383/16 |
| 5,182,895 | A | * | 2/1993 | Lugo | 206/554 |
| 5,209,385 | A | * | 5/1993 | Ledesma | 383/37 |
| 5,435,582 | A | * | 7/1995 | Davidson | 280/33.992 |
| 5,507,507 | A | * | 4/1996 | Davidson | 280/33.991 |
| 5,531,366 | A | * | 7/1996 | Strom | 383/15 |
| 5,580,173 | A | * | 12/1996 | Sebastian | 383/120 |
| 5,918,798 | A | * | 7/1999 | Frahm | 229/117.07 |
| 6,206,224 | B1 | * | 3/2001 | Potts et al. | 220/495.06 |
| 6,918,699 | B2 | * | 7/2005 | Hanson | 383/120 |
| D582,789 | S | * | 12/2008 | Blinderman et al. | D9/704 |
| 2004/0223664 | A1 | * | 11/2004 | Martin et al. | 383/37 |
| 2004/0252919 | A1 | * | 12/2004 | Welch | 383/110 |
| 2005/0034948 | A1 | | 2/2005 | Tiramani | |
| 2008/0187252 | A1 | * | 8/2008 | Dabrazzi | 383/113 |

* cited by examiner

FOREIGN PATENT DOCUMENTS

| | | |
|---|---|---|
| JP | 2005-124953 | 5/2005 |
| KR | 20-0362184 | 9/2004 |
| WO | WO-2007/083854 | 7/2007 |

*Primary Examiner* — Byron P Gehman

(57) ABSTRACT

A reusable packaging system includes a series of four bags, each designed to be reusable and capable of standing upright when in an open state. The bags are constructed so that they will fit in an open state within a shopping cart, and differ progressively in size so that they can be nested inside of each other for storage. The nested bags are then folded to form a compact, single package which can be easily transported by a user to a store for shopping.

12 Claims, 5 Drawing Sheets

GROCERY CART BAGGING SYSTEM

CROSS-REFERENCE TO RELATED APPLICATION

This application claims priority under 35 U.S.C. §119(e) to U.S. Provisional Patent Application No. 61/036,335, filed on Mar. 13, 2008 and entitled "Bagging System," which is hereby incorporated by reference herein in its entirety.

FIELD OF THE INVENTION

The present invention relates to a set of reusable bags for carrying purchased goods, and more particularly, to a set of reusable bags that can be compactly stored in a nested, folded configuration.

BACKGROUND OF THE INVENTION

It is typical today for a customer to use a large number of plastic bags when purchasing products, particularly in a grocery store and more often than not, much if not all of the purchased foods is packaged in plastic bags. Consequently, the use of plastic bags has become a significant environmental problem, in part because of the problem of disposing of such bags, but also because of green house gases emitted during manufacture and distribution.

SUMMARY OF THE INVENTION

The present invention provides a reusable packaging system intended for use in grocery stores or the like. The invention reduces, and may eliminate, the need for disposable bags at the check-out counter.

In accordance with the invention, a series of bags (for example, four), designed to be reusable and capable of standing upright, are constructed so that they will fit within a shopping cart. Preferably, the bags differ progressively in size so that they can be nested inside of each other and then folded into a compact package which can be conveniently stored by the customer and later taken to a store for shopping.

BRIEF DESCRIPTION OF THE DRAWINGS

The present inventions will become more readily apparent from the Detailed Description of the Invention, which proceeds with reference to the drawings, in which.

DETAILED DESCRIPTION OF THE INVENTION

A preferred embodiment the present invention is described below in reference to the drawings. This embodiment is provided to illustrate principles of the present invention, and is intended to be non-limiting.

Figure 1:
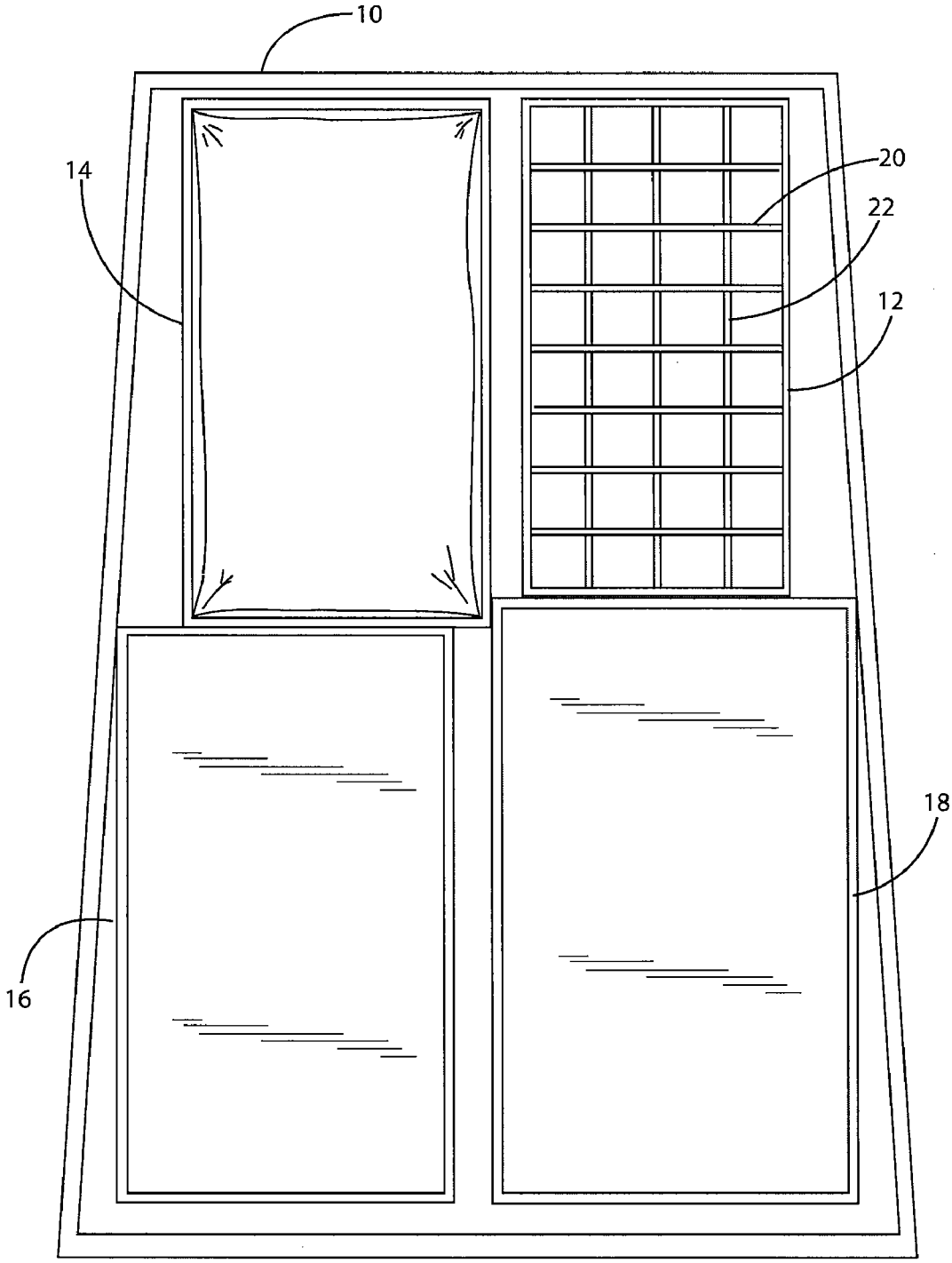
FIG. 1 is a top view of conventional shopping cart, show a typical arrangement of the bags according to the invention.

FIG. 1 is a top view showing a grocery cart 10 containing bags 12, 14, 16 and 18 in an open state, and positioned in the grocery cart 10 in a generally two-by-two, side-by-side arrangement. As illustrated, the cross sectional area of the open bags varies slightly, with bag 12 having the smallest area and 18 the largest.

The individual bags may be constructed so that groceries can be separated by category. For example, the smallest bag 12 may contain horizontal and vertical elasticized partitions 20 and 22 to facilitate use of the bag to hold bottles and other containers. The next larger bag 14 may be insulated to be used to hold cold (or warm) items. A closable top (not shown) may also be included. The third bag 16 may be leak proof for holding wet produce. The largest bag 18 can be used for paper, dry goods, and the like.

Figure 2:
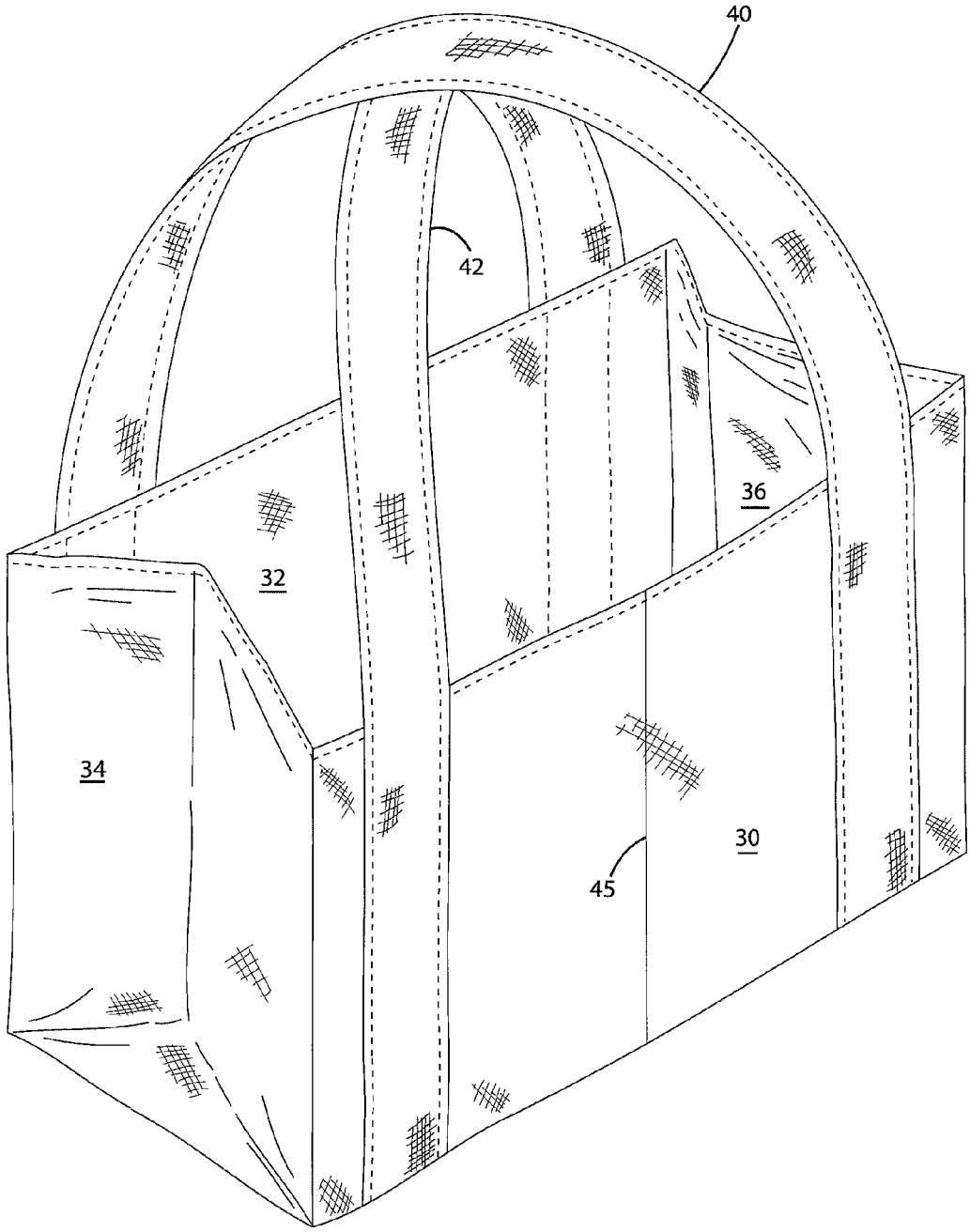
FIG. 2 is a perspective view of a preferred bag according to the invention.
Figure 3:
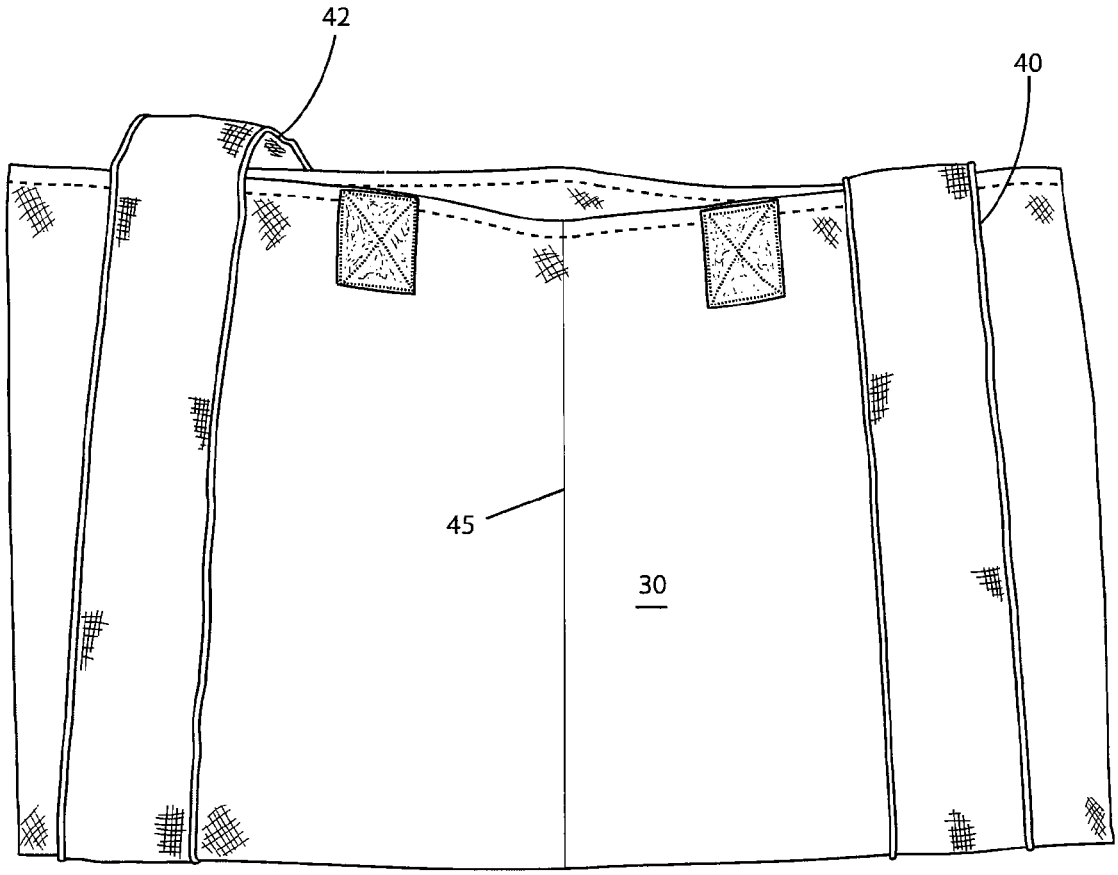
FIG. 3 is a side view of the bag.
Figure 4:
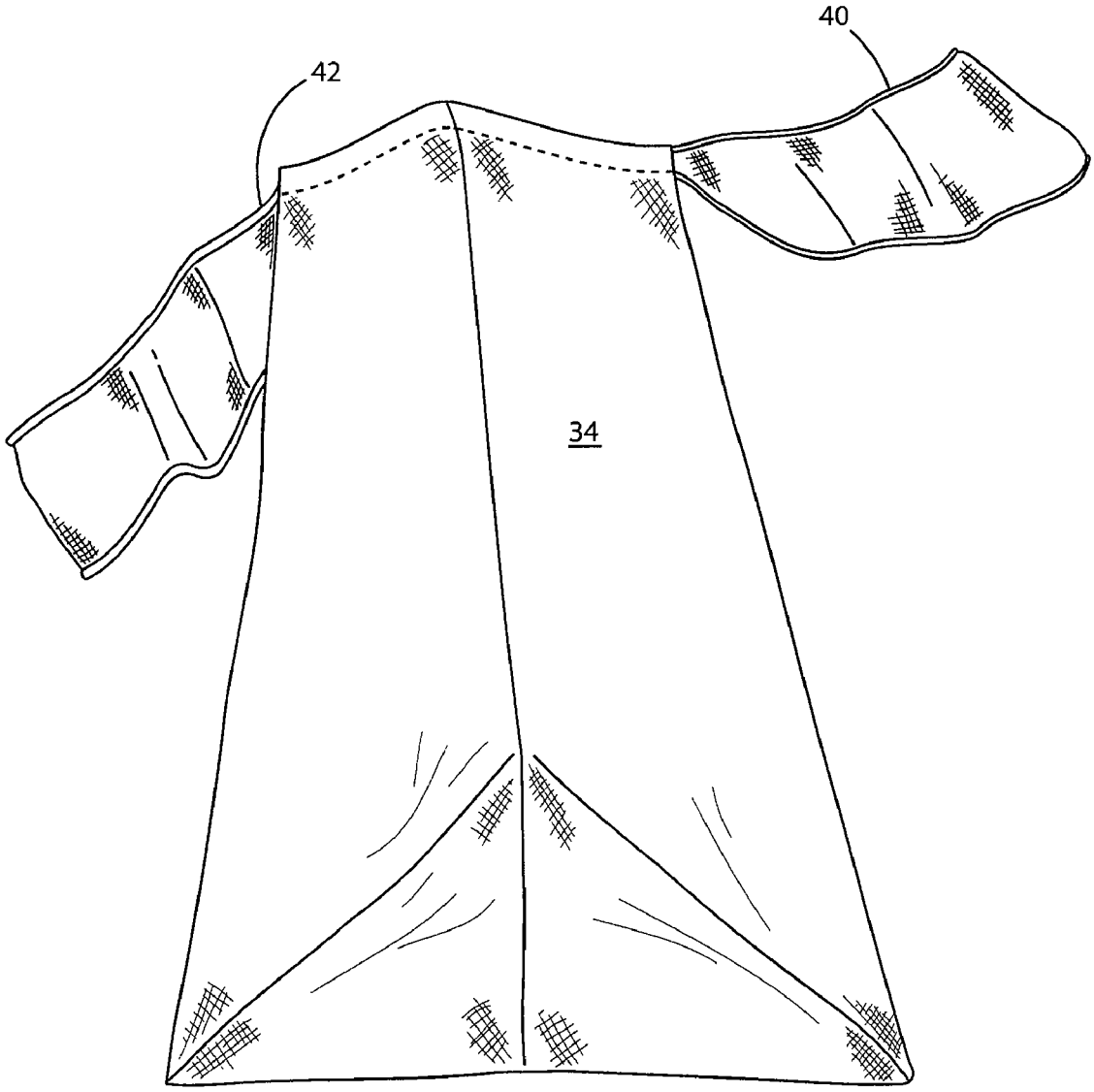
FIG. 4 is an end view of the bag.
Figure 5:
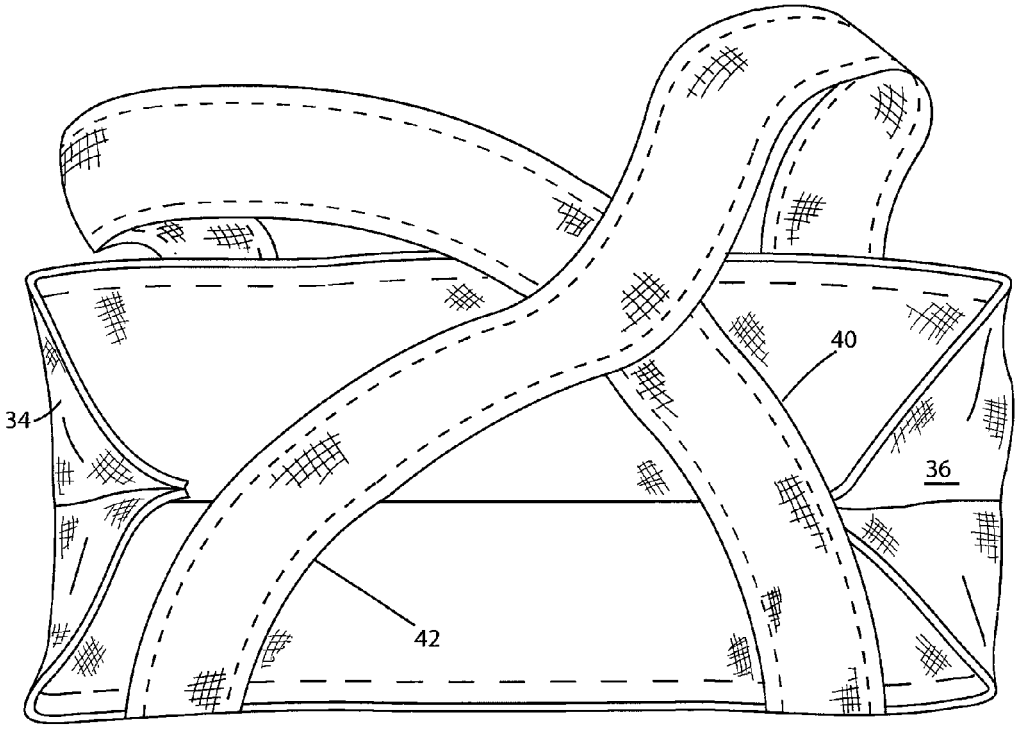
FIG. 5 is a top view of the bag.
Figure 6:
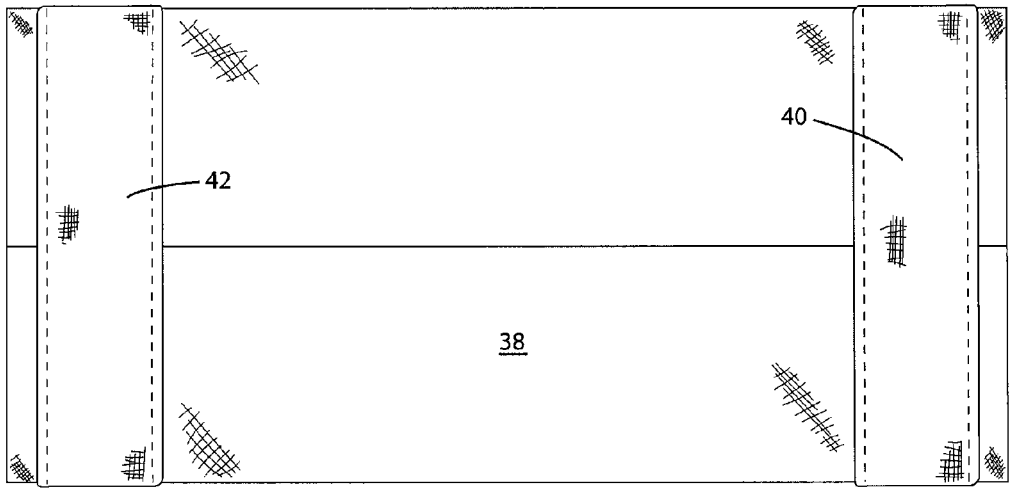
FIG. 6 is a bottom view of the bag.

A preferred embodiment of a bag that may be used in accordance with the invention is shown in FIG. 2. The bag portion itself is conventional and consists of front and rear panels 30 and 32, respectively, pleated side panels 34 and 36, and a pleated bottom panel 38 (FIG. 6). This construction as described can be easily flattened by collapsing the pleated panels 34, 36 and 38.

In the preferred embodiment, one or more of the bags may preferably include handles in the form of straps 40 and 42 which cross as shown in FIG. 2. The straps 40 and 42 are not connected at their intersection. Preferably, the straps are formed by a single strip of material which is attached to the front panel 30, rear panel 32 and bottom panel 38 as shown and serve as shoulder straps to assist the customer in carrying the loaded bags over a shoulder. The crossed handle feature helps to prevent one of the straps from slipping off the shoulder (which often occurs with conventional straps when a bag is heavy). The straps can easily be folded away to provide full access to the bag's interior.

The bags can be made of many different types of material. Preferably, the material is relatively stiff so that when the bag is opened, the bag can stand on its own within the shopping cart. Particularly preferable is recycled polypropylene which itself is recyclable.

Because the bags differ progressively in size, the empty bags can be nested inside of each other. Thus, the largest bag 18 will receive bag 16, which in turn will receive bag 14, which in turn will receive bag 12. Once the bags have been placed inside of each other, they all can be collapsed together to form a compact package. It is also contemplated that the bags, after they have been nested together, can be folded lengthwise around the fold line 45 as an additional convenience feature.

The bags may be stored at the customer's home in this condition, and can be easily taken to a supermarket or other grocery store where they can be opened and placed within a grocery cart as shown in FIG. 1.

Thus, the invention provides a reusable packaging system which reduces the need to make, distribute and dispose of environmentally harmful plastic bags. The bags can easily be nested together in a form which is convenient for storage and transport between the user's home and a grocery store. The bags themselves can be easily packed at the checkout counter and will fit comfortably within the confines of a shopping cart. The bags may also include straps to assist in carrying the loaded bags Those skilled in the art will readily recognize additional numerous adaptations and modifications which can be made to the present invention which fall within the scope of the invention as defined in the claims. Moreover, it is intended that the scope of the present invention include all foreseeable equivalents to the structures as described with reference to FIGS. 1-8. Accordingly, the invention is to be limited only by the scope of the claims and their equivalents.

We claim:

1. A bagging system for sorting groceries by categories within a conventional grocery cart, the system comprising:

a plurality of bags, each bag comprising:

a front panel, a rear panel, two side panels, and a bottom panel, wherein the side and bottom panels include pleats configured for folding the bag into a flattened state, wherein each one of the plurality of bags has a cross-sectional area in a plane parallel to the bottom panel of the bag and in an open state that is either greater or less than the cross-sectional area of each of the others of the plurality of bags, and the bags are configured to be folded together in the flattened state to form a compact package, wherein the plurality of bags includes:

a first bag comprising one or more partitions in an interior volume of the bag for holding items associated with a first category of groceries including containers, a second bag comprising an interior volume that is insulated for carrying items associated with a second category of groceries including cold items or warm items, a third bag comprising an interior volume that is water-resistant for carrying items associated with a third category of groceries including produce, and a fourth bag configured for carrying items associated with a fourth category of groceries including paper and dry goods, and wherein the different cross-sectional areas of the first, second, third and fourth bags are selected and sized so that the four bags can be adjacently positioned in the open state in a generally two-by-two, side-by-side arrangement, to substantially fill an interior volume of the interior basket compartment of the conventional grocery cart and so that interior volumes of the first, second, third and fourth bags are fully accessible from above the cart, whereby the first, second, third and fourth bags as positioned in the open state in the conventional grocery cart enable groceries of the first, second, third and fourth categories each to be segregated within substantially fixed portions of the interior volume of the interior basket compartment of the cart.

2. The bagging system of claim 1, further comprising:

the conventional grocery cart, wherein the four bags are adjacently positioned in the open state in the generally two-by-two, side-by-side arrangement within the interior basket compartment of the conventional grocery cart.

3. The bagging system of claim 1, wherein the one or more partitions of the first bag are formed from an elasticized material.

4. The bagging system of claim 1, wherein the one or more partitions of the first bag comprise a plurality of partitions that are configured in a grid.

5. The bagging system of claim 1, wherein one or more of the plurality of bags further comprises a closable top panel.

6. The bagging system of claim 1, wherein one or more of the plurality of bags further comprises handles configured for carrying the bag.

7. The bagging system of claim 1, wherein the front, rear and side panels of at least one of the plurality of bags are free-standing when the bag is in the open state.

8. The bagging system of claim 7, wherein the front, rear and side panels of one or more of the plurality of bags comprise polypropylene.

9. The bagging system of claim 1, wherein each one of the plurality of bags further comprises a fold line extending vertically along a central axis of each of the front and rear panels, and the flattened bags are folded about respective fold lines to form the compact package.

10. The bagging system of claim 1, wherein:

the four bags are folded together into the flattened state, and the fourth bag has a largest cross-sectional area among the four bags and surrounds the other bags in the flattened state to form the compact package.

11. The bagging system of claim 1, wherein the first category of groceries includes bottles.

12. A bagging system for sorting groceries by categories within a conventional grocery cart, the system comprising:

a plurality of bags, each bag comprising:

a front panel, a rear panel, two side panels, and a bottom panel, wherein the side and bottom panels include pleats configured for folding the bag into a flattened state, wherein each one of the plurality of bags has a cross-sectional area in a plane parallel to the bottom panel of the bag and in an open state that is either greater or less than the cross-sectional area of each of the others of the plurality of bags, and the bags are configured to be folded together in the flattened state to form a compact package, wherein the plurality of bags includes:

a first bag comprising one or more partitions in an interior volume of the bag for holding items associated with a first category of groceries including containers, a second bag comprising an interior volume that is insulated for carrying items associated with a second category of groceries including cold items or warm items, a third bag comprising an interior volume that is water-resistant for carrying items associated with a third category of groceries including produce, and a fourth bag configured for carrying items associated with a fourth category of groceries including paper and dry goods, and wherein the first, second, third and fourth bags having different cross-sectional areas are simultaneously positioned in the open state in an interior basket compartment of the conventional grocery cart such that the four bags in the open state substantially fill an interior volume of the interior basket compartment of the conventional grocery cart, so that interior volumes of the first, second, third and fourth bags are fully accessible from above the cart, whereby the first, second, third and fourth bags as positioned in the open state in the conventional grocery cart enable groceries of the first, second, third and fourth categories each to be segregated within substantially fixed portions of the interior volume of the interior basket compartment of the cart.

* * * * *